US010136788B2

(12) United States Patent
O'Connell et al.

(10) Patent No.: US 10,136,788 B2
(45) Date of Patent: Nov. 27, 2018

(54) BROOM

(71) Applicant: Michael John O'Connell, Marangaroo (AU)

(72) Inventors: Michael John O'Connell, Marangaroo (AU); Edward Joseph Khoury, Bateman (AU)

( * ) Notice: Subject to any disclaimer, the term of this patent is extended or adjusted under 35 U.S.C. 154(b) by 832 days.

(21) Appl. No.: 14/896,922

(22) PCT Filed: Feb. 28, 2013

(86) PCT No.: PCT/AU2013/000185
§ 371 (c)(1),
(2) Date: Dec. 8, 2015

(87) PCT Pub. No.: WO2013/126959
PCT Pub. Date: Sep. 6, 2016

(65) Prior Publication Data

US 2016/0128539 A1 May 12, 2016

(30) Foreign Application Priority Data

Mar. 1, 2012 (AU) ..... 2012900809

(51) Int. Cl.
*A47L 13/12* (2006.01)
*A46B 17/08* (2006.01)

(52) U.S. Cl.
CPC ..... *A47L 13/12* (2013.01); *A46B 17/08* (2013.01); *A46B 2200/302* (2013.01)

(58) Field of Classification Search
CPC ... A47L 13/12; A46B 17/08; A46B 2200/302; A46B 15/0081
USPC ..... 15/111, 236.01, 159.1
See application file for complete search history.

(56) References Cited

U.S. PATENT DOCUMENTS 1,402,485 A * 1/1922 Pederson ..... A47L 13/12 15/111
3,097,384 A * 7/1963 Clark ..... A47L 13/12 15/111
3,968,535 A * 7/1976 Nichols, Jr. ..... A47L 1/06 15/105
4,785,489 A * 11/1988 Von Doehren ..... A46B 5/0062 15/111
5,072,479 A * 12/1991 Van Niekerk ..... A46B 3/005 15/111
5,123,138 A * 6/1992 Flamm ..... A47L 13/12 15/111
5,309,654 A * 5/1994 Mathis ..... E01H 5/12 15/111
6,216,306 B1 * 4/2001 Esterson ..... A46B 5/02 15/111
2007/0266510 A1 * 11/2007 Weaver ..... A46B 15/0055 15/117

(Continued)

*Primary Examiner* — Weilun Lo
(74) *Attorney, Agent, or Firm* — Tope-McKay & Associates

(57) ABSTRACT

A broom (10) comprising a head (12) and a handle (14). The head (12) comprises a first portion (16) having a plurality of bristles and a second portion (17) extending outwardly from the first portion (16) at an angle thereto. A recess (28) extends from adjacent a first end of the second portion (17) to adjacent a second end of the second portion (17) and a scraper blade (30) is fixed at least partially within the recess (28) such that at least portions of longitudinal ends of the scraper blade (30) are covered.

18 Claims, 9 Drawing Sheets

(56) References Cited

U.S. PATENT DOCUMENTS

2012/0279520 A1* 11/2012 Sarris ..... A46B 17/08
134/6

* cited by examiner

SECTION F-F

BROOM

FIELD OF THE INVENTION

The present invention relates to a broom.

BACKGROUND TO THE INVENTION

When using a broom, it is often required also to have access to other implements for cleaning the ground. In particular, in circumstances where the broom is not sufficient to remove debris from the ground, a scraper may be required.

Scraper devices are available for this purpose and scraper attachments have also been proposed for brooms so that a separate device is not required. Such scrapers though are generally a separate blade device fixed to the broom above the head near the handle. The blade extends forwardly of the head so the scraper can be used by inverting the broom head. Such devices have disadvantages in that this construction results in a blade which is not particularly strong. The scraper blade may therefore be useful for some applications but not for heavy industrial type use. Further, the scraper blades are generally simply a flat metal blade extending along the width of the broom head. Such blades have exposed side edges which can contact surface such as nearby walls and cause damage.

The present invention relates to a broom having an incorporated scraper aimed at overcoming, least in part, the abovementioned problems.

SUMMARY OF THE INVENTION

According to one aspect of the present invention there is provided a broom comprising a head and a handle, wherein the head comprises: a first portion having a plurality of bristles on a first side surface thereof; a second portion extending outwardly from a first longitudinal side of the first portion at an angle thereto;

a recess in a distal edge of the second portion extending from adjacent a first end of the second portion to adjacent a second end of the second portion; a scraper blade comprising an elongate member fixed at least partially within the recess such that at least portions of longitudinal ends of the scraper blade are enclosed by end sections of the second portion located between the ends of the recess and longitudinal ends of the second portion;

wherein the outer edge of the scraper blade extends beyond the second portion of the head in order to contact the ground for scraping.

Preferably an inner edge of the scraper blade is embedded within the second portion of the head.

Preferably the scraper blade includes a plurality of holes located adjacent the inner edge such that material of the second portion of the head passes through the holes.

In a preferred embodiment, the first and second portions of the head of the broom comprise an integral unit formed around the scraper blade.

In a preferred embodiment, longitudinal ends of the scraper blade are provided with protrusions adjacent the inner edge thereof, wherein the protrusions are each encased in the adjacent end sections to secure the scraper blade.

Preferably the protrusions include at least one of the holes through which the material of the head extends.

In a further embodiment, the inner edge of the scraper blade includes a transverse flange to further secure the scraper blade within the head.

Preferably the scraper blade is generally parallel to the handle and offset from the longitudinal axis of the handle.

In one embodiment, the head is provided with a sleeve extending outwardly from the first side surface to receive an end of the handle, the sleeve being oriented at an angle to an axis perpendicular to the first portion of the head and parallel to the second portion.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1B:
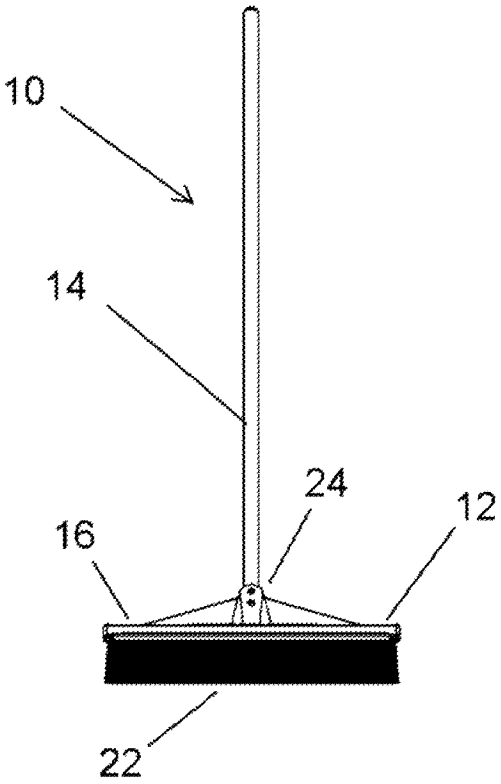
FIG. 1*b* is a front view of the broom of FIG. 1*a;*
Figure 1A:
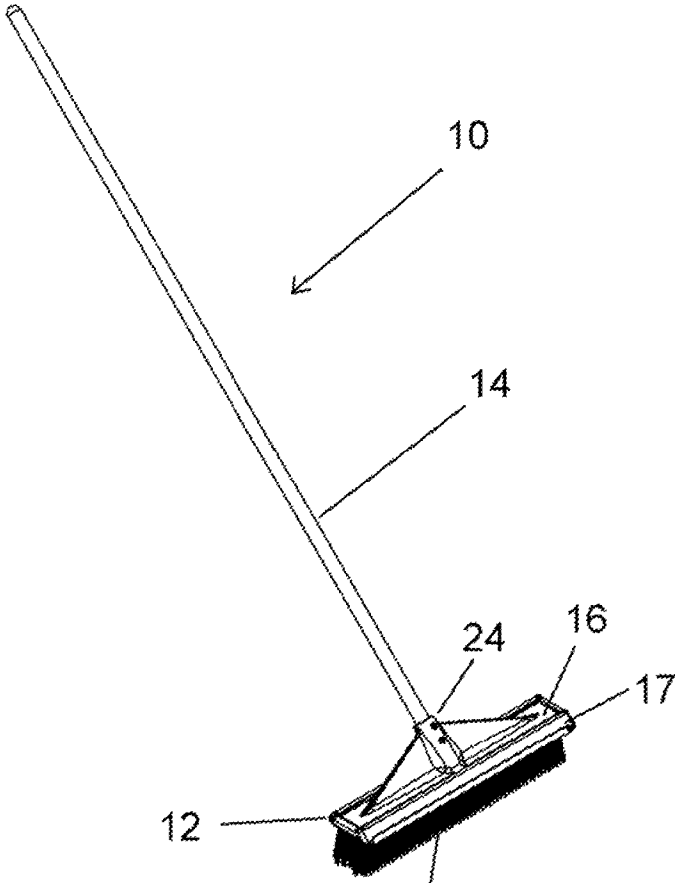
FIG. 1*a* is an upper perspective view of a broom in accordance with the present invention.

Referring to Figures, there is shown a broom 10 comprising a head 12 and a handle 14. The head 12 comprises a first portion 16 being generally planar and rectangular in shape such that the first portion 16 includes first and second opposed longitudinal sides 18 and 19 and first and second opposed ends 20 and 21. The handle 14 is secured to the first portion 16 of the head 12 on a first side surface thereof and a second opposed side surface is provided with a plurality of bristles 22 for sweeping.

The head 12 is provided with a sleeve 24 extending outwardly from the first side surface thereof. An end of the handle 14 is received within the sleeve 24 and secured to the head 12 with securing screws 26 which pass through holes in the sleeve 24 into the handle 14. The sleeve 24 comprises a cylindrical sleeve and extends from the head 12 at an angle to an axis perpendicular to the first portion 16 thereof. The sleeve 24 is angled away from the first longitudinal side 18 of the head 12. As can be seen in the Figures, when the first portion 16 of the head 12 is held generally horizontally, the handle 14 is oriented at an angle to the vertical.

Figure 2A:
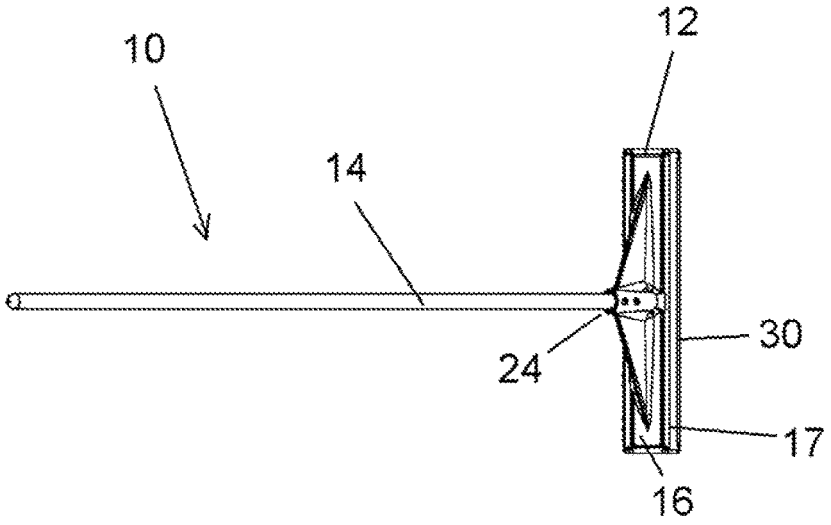
FIG. 2*a* is a top view of the broom of FIG. 1.
Figure 2B:
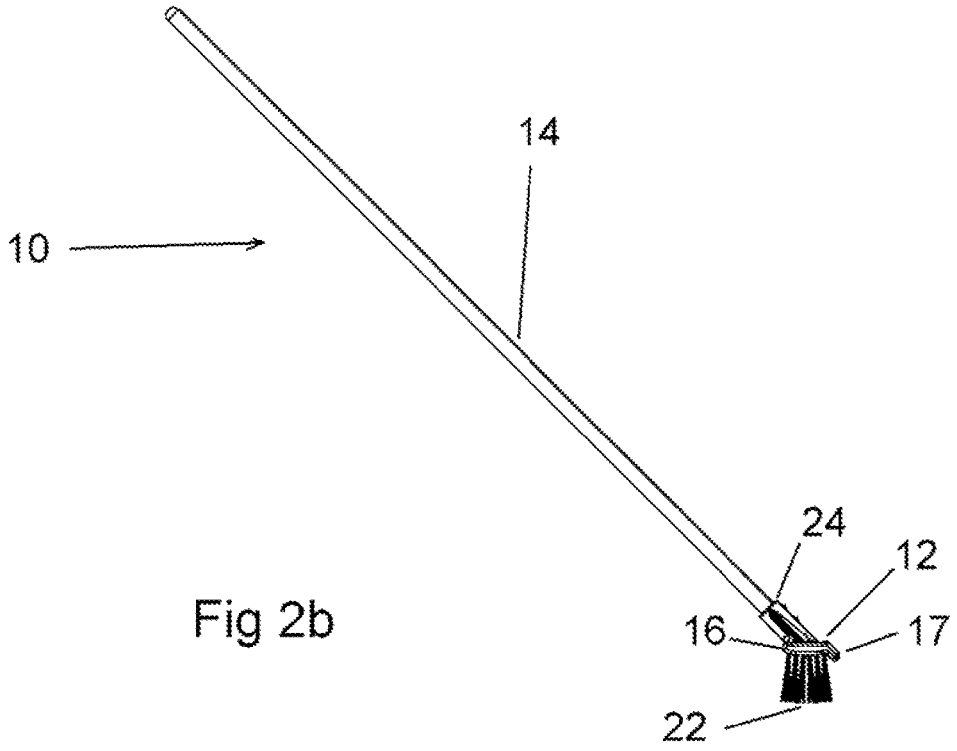
FIG. 2*b* is a side view of the broom of FIG. 1.
Figure 3A:
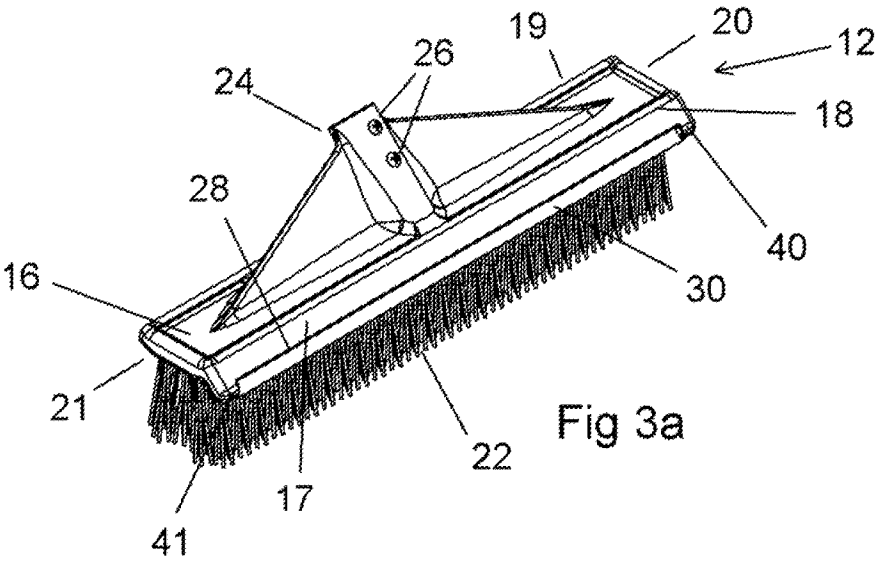
FIG. 3*a* is an upper perspective view of the head of the broom of FIG. 1.
Figure 3B:
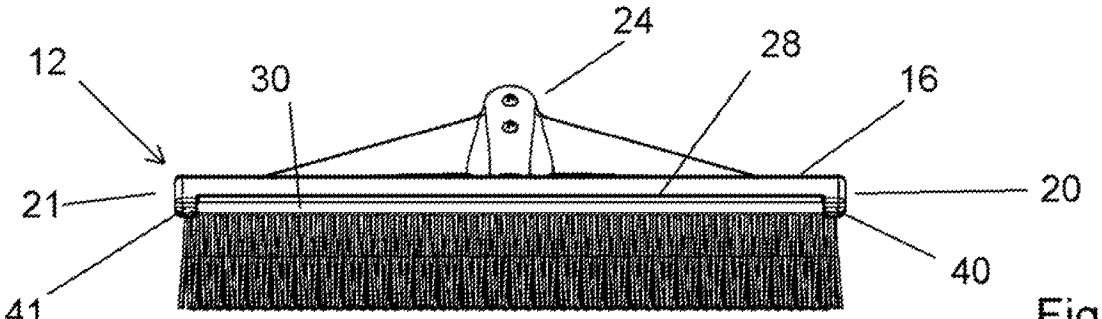
FIG. 3*b* is a front view of the head of the broom of FIG. 1.
Figure 4A:
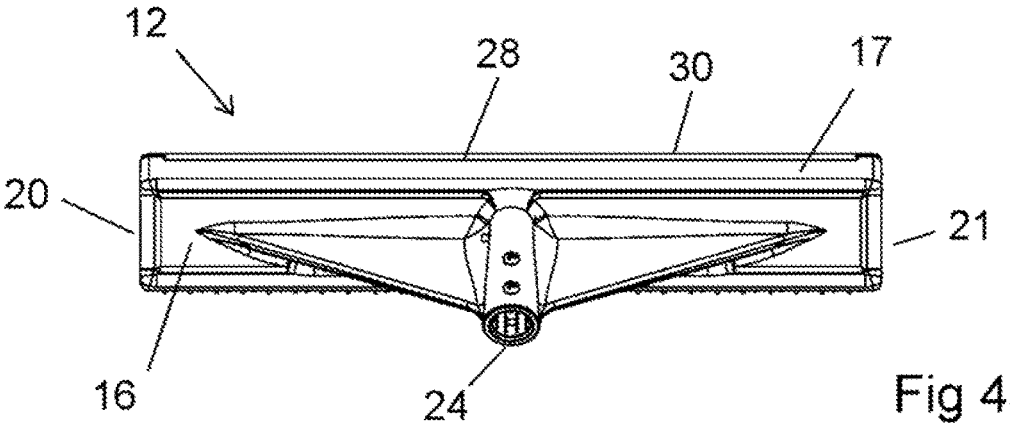
FIG. 4*a* is a top view of the head of the broom of FIG. 1.
Figure 4B:
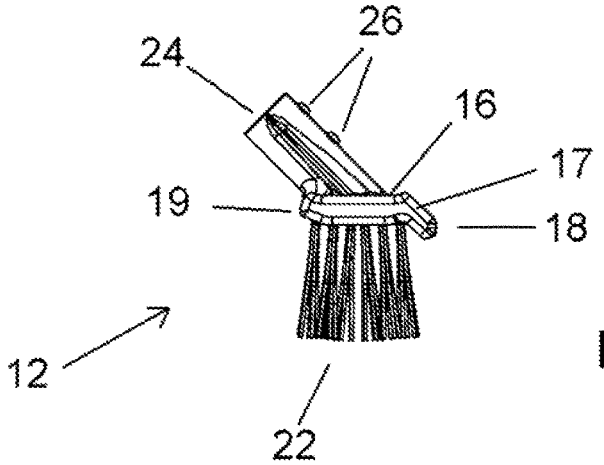
FIG. 4*b* is a side view of the head of the broom of FIG. 1.
Figure 5B:
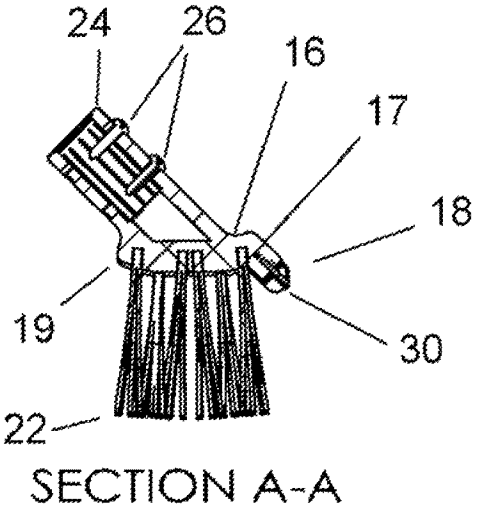
FIG. 5*b* is a side cross sectional view of the head of FIG. 5*a* through the line A-A.
Figure 5A:
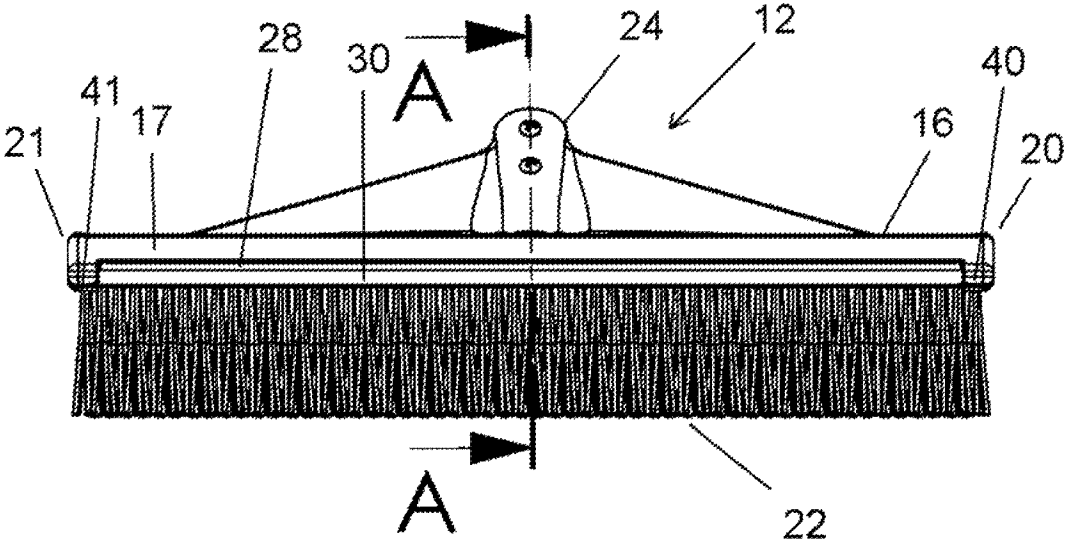
FIG. 5*a* is a front view of the head of the broom of FIG. 1.

The head 12 includes also a second portion 17. The second portion 17 extends outwardly from along the first longitudinal side 18 of the first portion 16. The second portion 17 is also generally planar and extends at an angle to the first portion 16 such that when the first portion 16 is oriented horizontally, the second portion 17 extends downwardly. The angle of the second portion 17 of the head 12 is such that the second portion 17 is generally parallel to the sleeve 24, and therefore the handle 14 (as can be seen in FIG. 2*b*).

The second portion 17 of the head 12 includes a recess 28 in a distal edge thereof. The recess 28 extends from adjacent to the first end 20 of the head 12 to a location adjacent the second end 21 of the head 12. The length of the recess 28 is less than the length of the head 12 from the first end 20 to the second end 21. The second portion 17 of the head 12 therefore includes a first end section 40 defined between the recess 28 and the first end 20 of the head 12 and a second end section 41 defined between the recess 28 and the second end 21 of the head 12.

A scraper blade 30 is received in the recess 28. The scraper blade 30 comprises a planar blade secured within the recess 28 such that the scraper blade 30 is generally parallel to the second portion 17 of the head 12. The scraper blade 30 includes an outer edge 42 located remote from the second portion 17 of the head 12 and an inner edge 43 located adjacent the second portion 17 of the head 12. The inner and outer edges 43 and 42 are parallel such that the scraper blade 30 is generally rectangular in shape.

Figure 6:
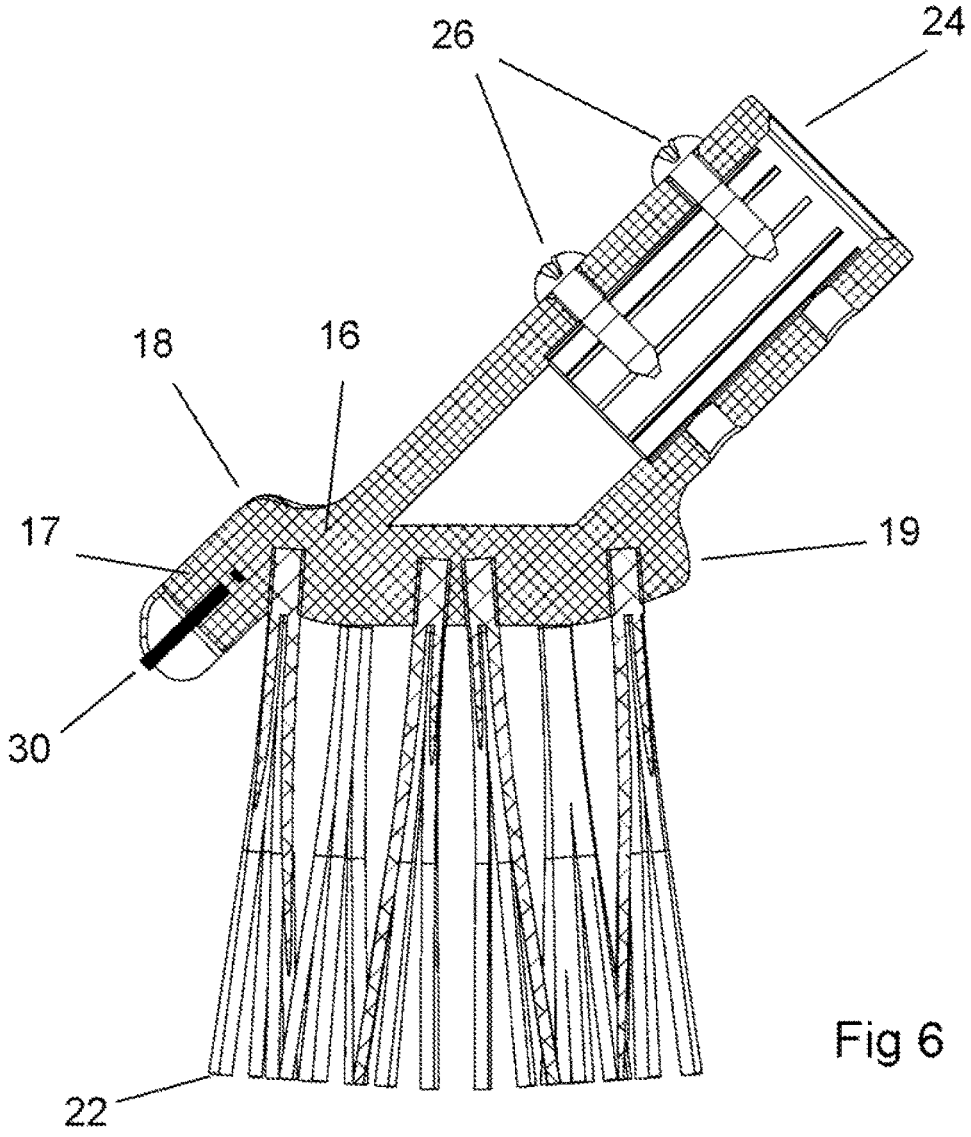
FIG. 6 is a close up view of the cross section of the head of FIG. 5*b;*
Figure 7C:
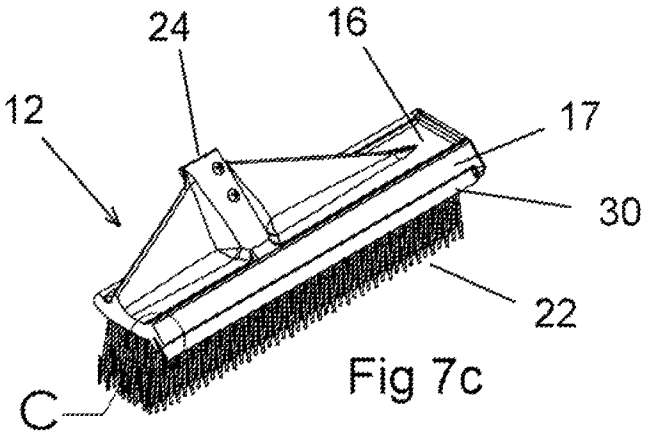
FIG. 7*c* is an upper perspective view of the head of the broom of FIG. 1 with an end portion of the head cut away.
Figure 7D:
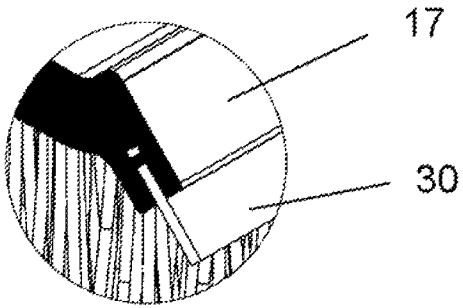
FIG. 7*d* is a close up view of Detail C of FIG. 7*c;*
Figure 7A:
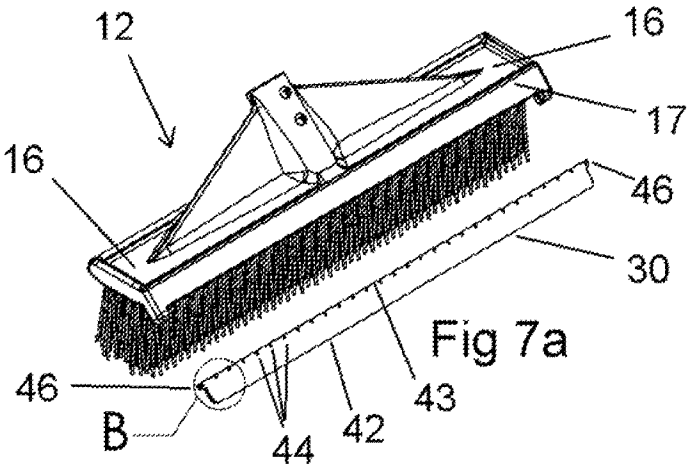
FIG. 7*a* is an exploded view of the head of the broom of FIG. 1.
Figure 7B:
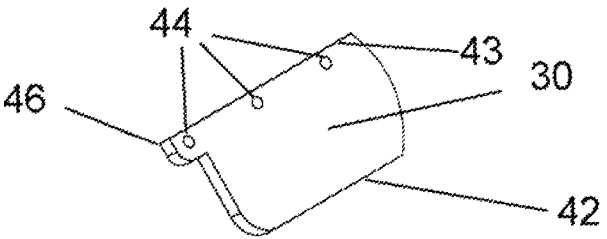
FIG. 7*b* is a close up view of Detail B of FIG. 7*a;*

The inner edge 43 of the scraper blade 30 is embedded within the second portion 17 of the head 12. As can be seen in FIGS. 7*a* and 7*b*, the scraper blade 30 includes a plurality of holes 44 located adjacent the inner edge 43. The head 12 of the broom 10 comprises an integral unit formed around the scraper blade 30 such that the inner edge 43 of the scraper blade 30 is embedded within the second portion 17 of the head 12 with the material of the second portion 17 passing through the holes 44. FIGS. 6 and 7*d* show views of the holes 44 and the material of the second portion 17 of the head 12 passing through the holes 44. With this construction, the scraper blade 30 is permanently engaged and held into the second portion 17 of the head 12. This arrangement provides sufficient strength to allow extended use of the scraper blade 30 without damage or bending of the scraper blade 30. The first and second portions 16 and 17 of the head 12 are preferably formed of single unit moulded from an appropriate material.

In a further embodiment, the inner edge 43 of the scraper blade 30 may include a transverse flange (not shown). The transverse flange would be provided to further secure the scraper blade 30 within the head 12.

At least portions of the longitudinal ends of the scraper blade 30 are covered by the first and second end sections 40 and 41, located either end of the recess 28. The first and second end sections 40 and 41 of the second portion 17 of the head 12 act to prevent the longitudinal ends of the scraper blade 30 contacting, and unintentionally damaging any nearby surfaces. Further, the longitudinal ends of the scraper blade 30 are provided with protrusions 46 adjacent the inner edge 43. The protrusions 46 are each encased in the adjacent first or second end section 40 or 41. As can be seen in FIG. 7*b*, the protrusions 46 also include at least one of the holes 44. The protrusions 46 further act to secure the scraper blade 30 and prevent the scraper blade from pulling outwardly from the recess 28.

Figures 8A, 8B:
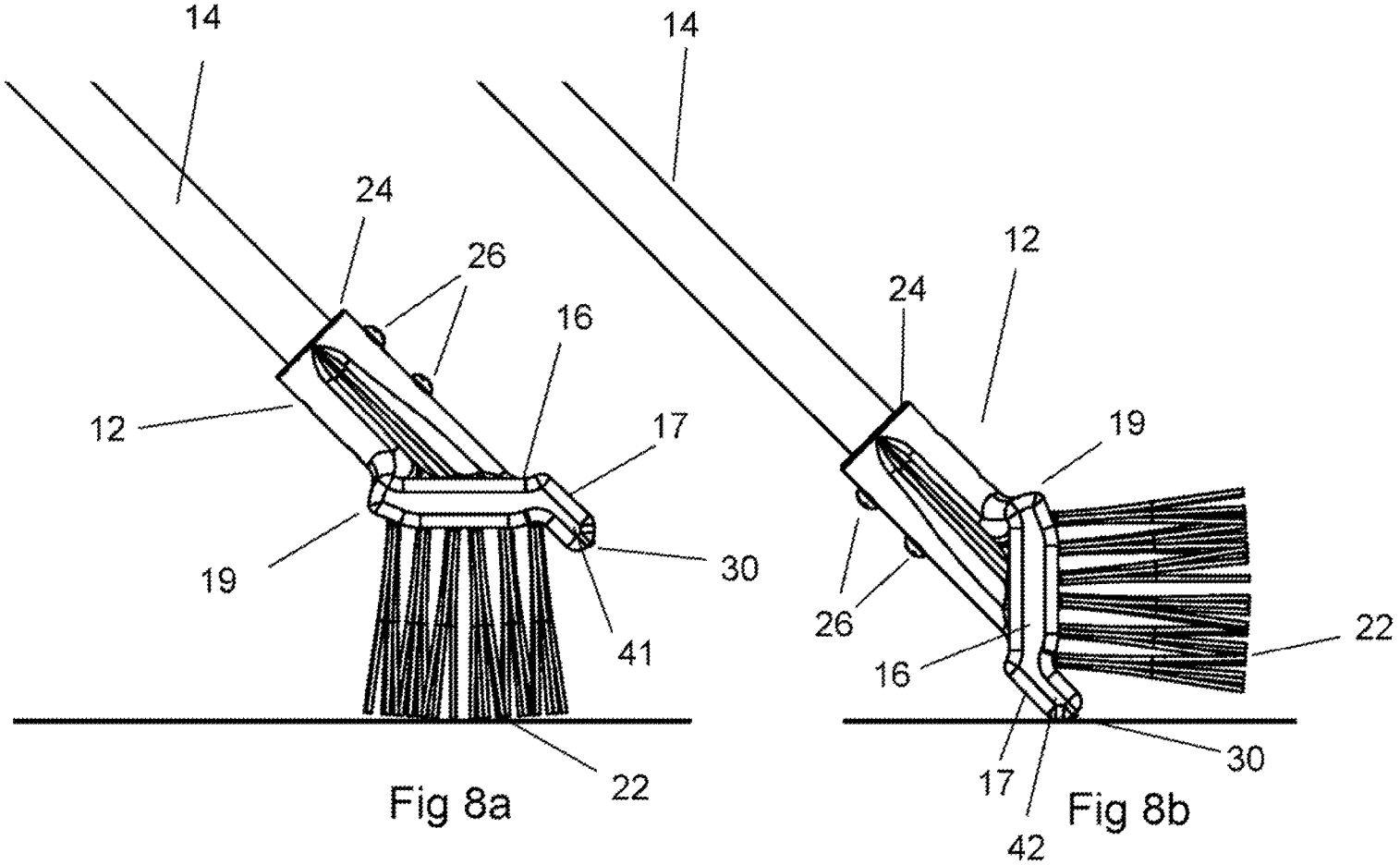
FIG. 8*a* is a side view of the head of the broom of FIG. 1 showing the bristles in use.
FIG. 8*b* is a side view of the head of the broom of FIG. 1 showing the scraper in use.
Figure 9C:
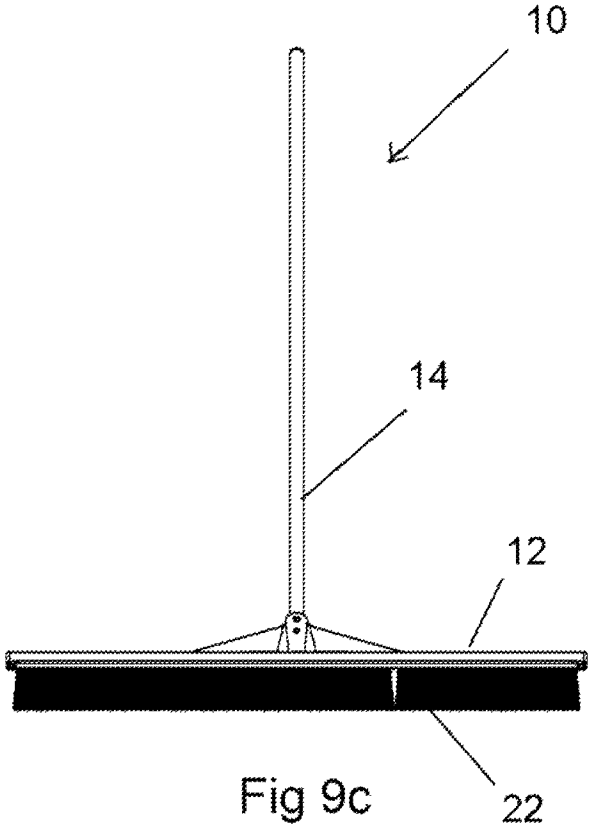
FIG. 9*c* is a front view of a third embodiment of a broom in accordance with the present invention having a still longer head.
Figure 9B:
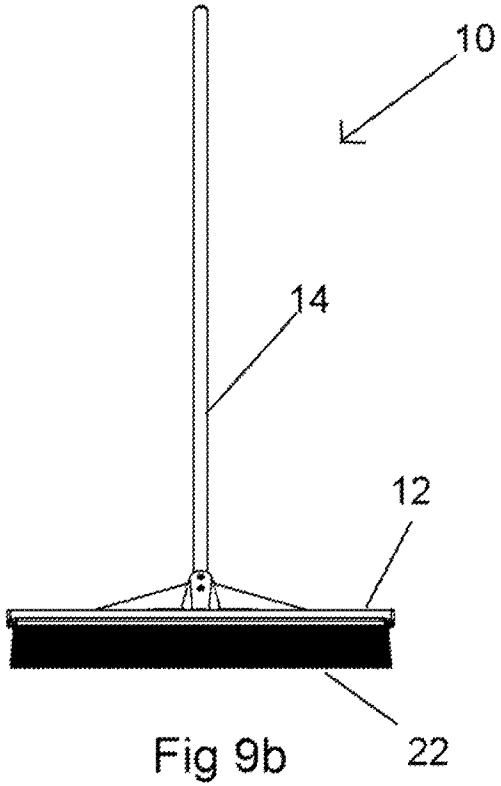
FIG. 9*b* is a front view of a second embodiment of a broom in accordance with the present invention having a longer head.
Figure 9A:
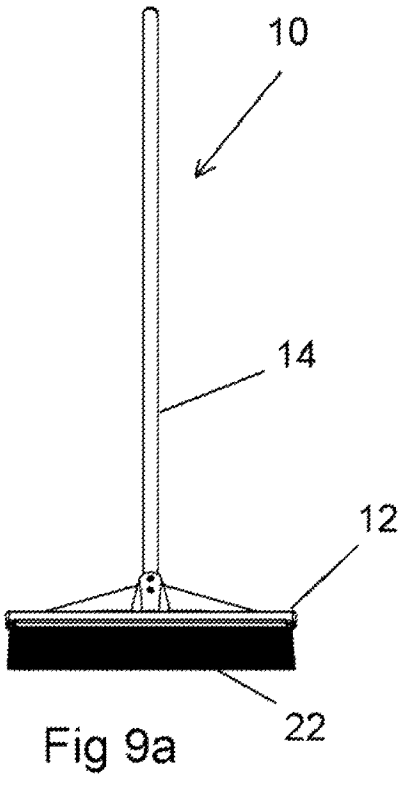
FIG. 9*a* is a front view of the broom of FIG. 1.

The outer edge 42 of the scraper blade 30 extends beyond the second portion 17 of the head 12 such that when the head 12 is turned so that the first portion 16 is generally vertical (as shown in FIG. 8*b*), the outer edge 42 of the scraper blade 30 may contact the ground.

In use, the broom 10 may be used in a normal manner for sweeping, as shown in FIG. 8*a*. When a scraper is required, the handle 14 of the broom 10 may be rotated about its longitudinal axis by 180 degrees as shown in FIG. 8*b*. In this configuration, the first portion 16 of the head 12 is oriented in a generally vertical plane and the scraper blade 30 is positioned lowermost. The scraper blade 30 is generally parallel to the handle 14 and offset below the longitudinal axis of the handle, as can be seen in FIG. 8*b*. The outer edge 42 of the scraper blade 30 can therefore be engaged with the ground and moved to scrape material from the ground by pushing the broom 10 forward.

It will be readily apparent to persons skilled in the relevant arts that various modifications and improvements may be made to the foregoing embodiments, in addition to those already described, without departing from the basic inventive concepts of the present invention.

What is claimed is:

1. A broom comprising a head and a handle, wherein the head comprises:

a first portion having a plurality of bristles on a first side surface thereof;

a second portion extending outwardly from a first longitudinal side of the first portion at an angle thereto;

a recess in a distal edge of the second portion extending from adjacent a first end of the second portion to adjacent a second end of the second portion;

a scraper blade comprising an elongate member fixed at least partially within the recess such that at least portions of longitudinal ends of the scraper blade are enclosed by sections of the second portion located between the ends of the recess and longitudinal ends of the second portion;

wherein the outer edge of the scraper blade extends beyond the second portion of the head in order to contact the ground for scraping.

2. A broom in accordance with claim 1, wherein an inner edge of the scraper blade is embedded within the second portion of the head.

3. A broom in accordance with claim 2, wherein the scraper blade includes a plurality of holes located adjacent the inner edge such that material of the second portion of the head passes through the holes.

4. A broom in accordance with claim 3, wherein the first and second portions of the head of the broom comprise an integral unit formed around the scraper blade.

5. A broom in accordance with claim 4, wherein longitudinal ends of the scraper blade are provided with protrusions adjacent the inner edge thereof, wherein the protrusions are each encased in the adjacent first or second end portion to secure the scraper blade.

6. A broom in accordance with claim 5, wherein the protrusions include at least one of the holes through which the material of the head extends.

7. A broom in accordance with claim 6, wherein the scraper blade is generally parallel to the handle and offset from the longitudinal axis of the handle.

8. A broom in accordance with claim 7, wherein the head is provided with a sleeve extending outwardly from the first side surface to receive an end of the handle, the sleeve being oriented at an angle to an axis perpendicular to the first portion of the head and parallel to the second portion.

9. A broom in accordance with claim 1, wherein the scraper blade is generally parallel to the handle and offset from the longitudinal axis of the handle.

10. A broom in accordance with claim 2, wherein the scraper blade is generally parallel to the handle and offset from the longitudinal axis of the handle.

11. A broom in accordance with claim 3, wherein the scraper blade is generally parallel to the handle and offset from the longitudinal axis of the handle.

12. A broom in accordance with claim 1, wherein the head is provided with a sleeve extending outwardly from the first side surface to receive an end of the handle, the sleeve being oriented at an angle to an axis perpendicular to the first portion of the head and parallel to the second portion.

13. A broom in accordance with claim 2, wherein the head is provided with a sleeve extending outwardly from the first side surface to receive an end of the handle, the sleeve being oriented at an angle to an axis perpendicular to the first portion of the head and parallel to the second portion.

14. A broom in accordance with claim 3, wherein the head is provided with a sleeve extending outwardly from the first side surface to receive an end of the handle, the sleeve being oriented at an angle to an axis perpendicular to the first portion of the head and parallel to the second portion.

15. A broom in accordance with claim 4, wherein the head is provided with a sleeve extending outwardly from the first side surface to receive an end of the handle, the sleeve being oriented at an angle to an axis perpendicular to the first portion of the head and parallel to the second portion.

16. A broom in accordance with claim 4, wherein the scraper blade is generally parallel to the handle and offset from the longitudinal axis of the handle.

17. A broom in accordance with claim 5, wherein the scraper blade is generally parallel to the handle and offset from the longitudinal axis of the handle.

18. A broom in accordance with claim 5, wherein the head is provided with a sleeve extending outwardly from the first side surface to receive an end of the handle, the sleeve being oriented at an angle to an axis perpendicular to the first portion of the head and parallel to the second portion.

* * * * *